United States Patent [19]

Hamilton

[11] Patent Number: 5,029,349

[45] Date of Patent: Jul. 9, 1991

[54] PREGNANCY SUPPORTING CHAIR ASSEMBLY

[76] Inventor: Valerie Hamilton, 109 President Ave., Lavallette, N.J. 08735

[21] Appl. No.: 524,843

[22] Filed: May 18, 1990

[51] Int. Cl.[5] ..... A47C 17/66; A47C 20/00

[52] U.S. Cl. ..... 5/111; 5/431; 5/462; 5/216; 297/219; 297/284

[58] Field of Search ..... 5/60, 110, 111, 187, 5/216, 431, 447, 462; 297/219, 284

[56] References Cited

U.S. PATENT DOCUMENTS

| | | | |
|---|---|---|---|
| 542,374 | 7/1895 | Sauerbier | 5/111 |
| 712,203 | 10/1902 | Pelletieri et al. | 5/111 |
| 1,566,574 | 12/1925 | Berg | 5/216 X |
| 3,289,222 | 12/1966 | Nielson | 297/284 X |
| 3,464,069 | 9/1969 | Bien | 5/462 X |
| 4,021,872 | 5/1977 | Powell | 5/462 |
| 4,051,566 | 10/1977 | Esquivel | 5/462 X |
| 4,054,960 | 10/1977 | Pettit et al. | 5/462 X |
| 4,508,384 | 4/1985 | Castelot et al. | 5/431 X |
| 4,921,301 | 5/1990 | Haynes | 5/110 X |

*Primary Examiner*—Michael F. Trettel
*Attorney, Agent, or Firm*—Clifford G. Frayne

[57] ABSTRACT

A chair assembly adaptable for comfortably supporting the abdomen of a pregnant woman in a prone position, the chair having a first, second and third support frame, the third support frame adjustable with respect to the first and second support frame for rotation from a horizontal position to a substantially vertical position, the third support frame having an adjustable abdomen support longitudinally positioned between its ends for cooperation with cushions positioned on the first support frame and the third support frame in order to support the abdomen of a pregnant woman while she reclines in a prone position.

5 Claims, 4 Drawing Sheets

PREGNANCY SUPPORTING CHAIR ASSEMBLY

FIELD OF INVENTION

The present invention relates to a chair assembly and, in particular, to a chair which is portable, collapsible and adjustable for use by an individual and particularly for a woman in the varying stages of pregnancy to permit such pregnant woman to recline on her stomach.

BACKGROUND OF THE INvENTION

The pregnant woman oftentimes finds it difficult, if not impossible, to recline in a prone position. This difficulty is enhanced as the term of pregnancy increases. Medical information indicates that it may be beneficial for a pregnant woman to recline in a prone position and from a practical aspect, the pregnant woman may wish to recline in a prone position to overcome the monotony or discomfort from sleeping or reclining in a supine position or on her side for the term of the pregnancy.

Oftentimes, the pregnant woman would have to resort to a makeshift situation of piling pillows on a bed in a particular manner in order to permit her to recline in the prone position. Outdoors, or at the beach, the pregnant woman would oftentimes have to mold the shape of the sand in order to accommodate her abdomen in order to recline in a prone position.

Various attempts had been directed towards easing these discomfort in providing a pregnant woman with the ability to recline on her abdomen.

In particular, U.S. Pat. No. 4,021,872 to Powell disclose a maternity mattress which contained a depression to accommodate a pregnant woman's abdomen when she reclined in a prone position. Additionally, U.S. Pat. No. 3,378,862 to Skinner disclosed a maternity mattress which would accommodate the abdomen of a pregnant woman. These devices are cumbersome and must be used on a support surface or the floor and limit the pregnant woman to a prone position.

U.S. Pat. No. 4,508,384 to Castelot discloses a pregnancy supporting lounge chair. This lounge chair provided a frame and webbing strips to accommodate a person in the normal fashion, and was adjustable to provide for a stretch band for use by a pregnant woman utilizing the chair in a prone position, the lateral stretch band accommodating the pregnant woman's abdomen.

While the prior art addresses the comfort of the pregnant woman by supporting her abdomen when in a prone position, none of the prior art patents address the comforting situation of the swelling of the breasts during pregnancy. Applicant's invention is directed towards a pregnancy supporting chair which will accommodate not only the expanded abdomen, but the swelling of the breasts during a pregnancy and provide a chair which can be converted from a chair to a cot and vice versa and used by either a pregnant woman or another individual.

The chair assembly disclosed herein is designed for multipurpose uses by any individual, for use as an upright chair or as a recliner in the total horizontal, position and because of its collapsible nature, can be transported easily and used at home, or outdoors. In particular, the chair is adaptable for use by a pregnant woman during the term of her pregnancy which allows for the adjustability of the chair to accommodate her abdomen and breasts comfortably during the term of the pregnancy and to provide such support comfortably without any transverse members which might impinge upon the individual's body.

OBJECTS OF THE INVENTION

An object of the present invention is to provide for a novel pregnancy supporting chair which converts from a chair to a cot.

A still further object of the present invention is to provide for a novel pregnancy supporting chair which can be used as a standard chair or cot or which can be converted for use as a chair or cot for a pregnant woman.

A still further object of the present invention is to provide for a novel pregnancy supporting chair which provides adjustable support for the expanding abdomen of a pregnant woman as well as for her breasts.

A still further object of the present invention is to provide for a novel pregnancy supporting chair which can be fully cushioned and which is yet portable and adjustable.

A still further object of the present invention is to provide for a novel pregnancy supporting chair which provides full longitudinal and lateral support for the expanded abdomen of a pregnant woman.

BRIEF DESCRIPTION OF THE DRAWINGS

These and other objects of the present invention will be readily evident upon a study of the following specification and the accompanying drawings wherein.

DETAILED DESCRIPTION OF THE DRAWINGS

Figure 1:
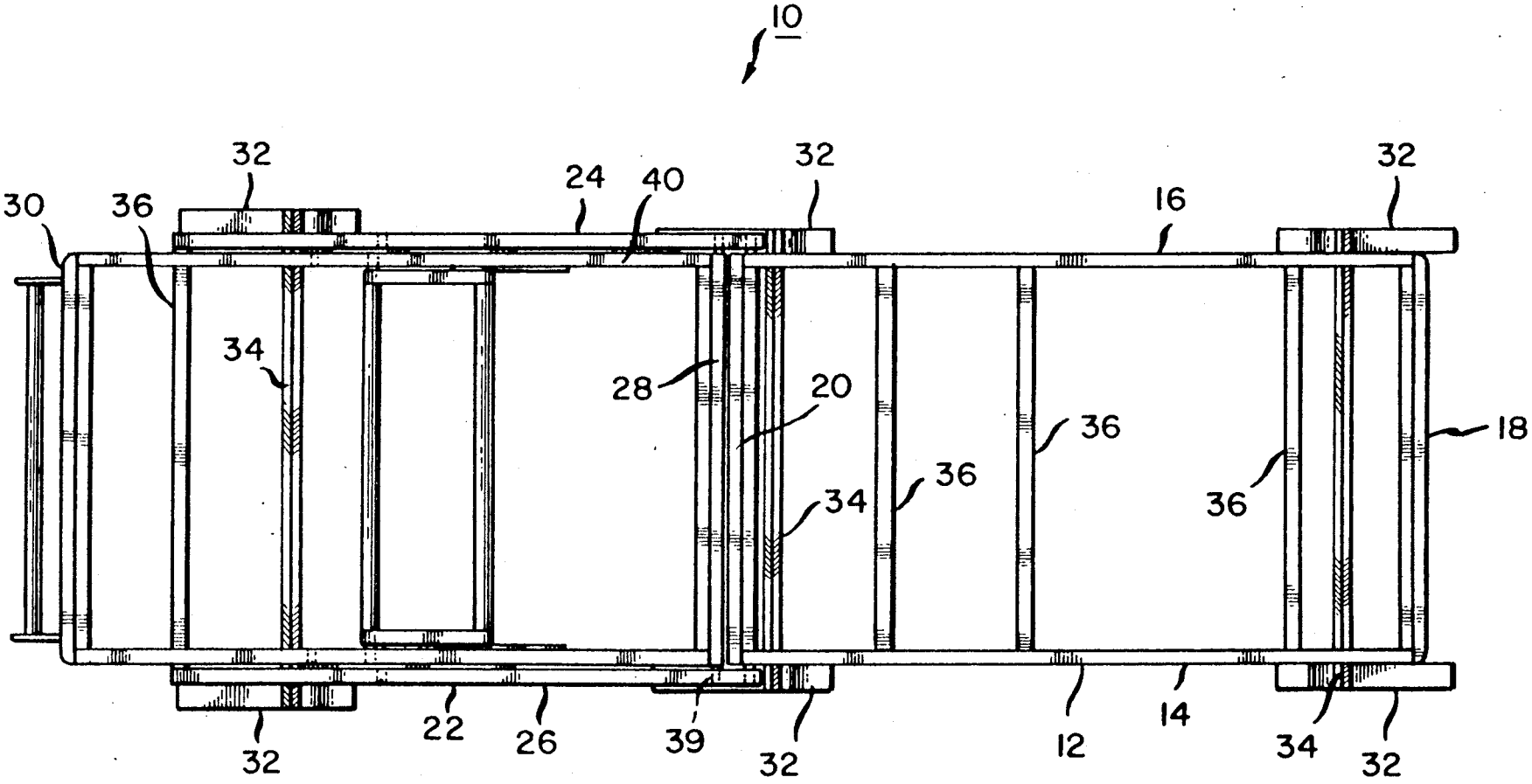
FIG. 1 is a top planar view of the frame of the chair.
Figure 2:
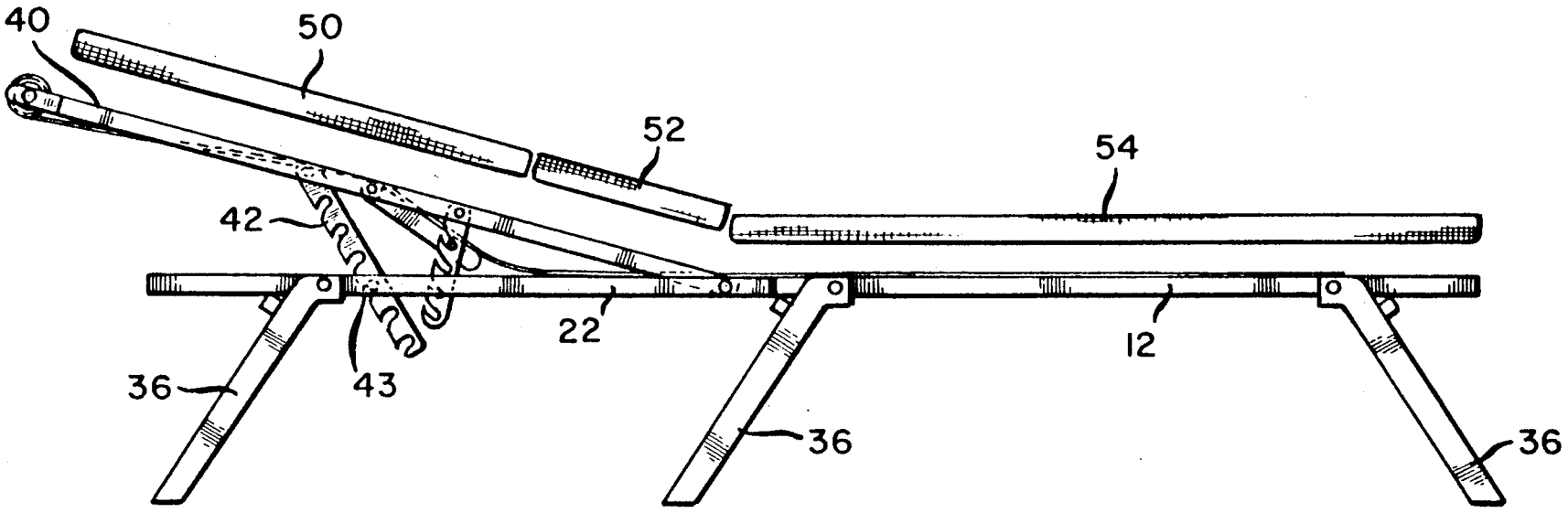
FIG. 2 is a side elevational view of the chair.

Referring to FIG. 1 and 2, there is shown first, a top planar view of the frame for pregnancy support chair 10 and a side elevational view of pregnancy support chair 10. Pregnancy support chair 10 is comprised of three generally rectangular support frames. First support frame 12 is comprised of longitudinal sides 14 and 16 and lateral ends 18 and 20. Second support frame 22 is comprised of longitudinal sides 24 and 26 and lateral ends 28 and 30. First support frame 12 and second support frame 22 are hingeably, rotatably secured at their lateral ends 20 and 28 respectively to permit first support frame 12 and second support frame 22 to be rotated into a folded position for easy transport and storage.

First support frame 12 and second support frame 22 have rotatably secured to their longitudinal sides 14, 16, 24 and 26 respectively, a plurality of support legs 32 rotatably secured to the longitudinal edges of first support frame 12 and second support frame 22. Support legs 32 are rotated to a position substantially in alignment with first support frame 12 and second support frame 22 for transport and storage and are rotated to an extended position in order to support the pregnancy supporting chair in an upright position above the ground. Additionally, support legs 32 may be in communication with the opposing support leg by means of a transverse support bar 34 in order to provide stability to the pregnancy supporting chair 10 when in the upright position and to facilitate the folding of the legs into a transport mode.

First support frame 12 has a series of transverse support arms 36 extending between the longitudinal sides 14 and 16 of first support frame 12 providing support for cushions described hereafter and ultimately, for support of the lower torso of the human body. Second support frame 22 has similar transverse support arms 36 positioned proximate to lateral end 30 of second support frame 22 in order to support third support frame 40. Third support frame 40 is slightly narrower than second support frame 22 and is hingeably rotatably secured at hinge 39 to second support frame 22 proximate to lateral end 28 to permit third support frame 40 to be moved from a substantially horizontal planer position to an upright, semi-reclining position. Third support frame 40 is maintained in this adjustable upright position by means of adjustable elevator arms 42 secured to third support frame 40 and adjustably secured to a support arm 43 attached to second support frame 22. This upright positioning is accomplished by selected notches or grooves in elevator arm 42 selectively engaging support arm 43.

FIG. 2, a side elevational view of pregnancy support chair 10 shows, in more detail, the relationship between third support frame 40 and second support frame 22, depicting third support frame 40 in a semi-upright position, nonplaner with second support frame 22. As shown in FIG. 2, three cushions, 50, 52 and 54 are associated with this embodiment of the chair. Cushion 54 is configured to cooperate with first support frame 12 to provide a cushion for the lower portion of the body. Cushions 50 and 52 are associated with and cooperate with third support frame 40 for cushioning and supporting the upper torso of the body. In the configuration shown in FIG. 2, the pregnancy support chair 10 is adaptable to support the body in a supine position. The adaptability of this chair for a pregnant woman concerns itself with features novel to third support frame 40 and best described with reference to FIGS. 3 and 4.

Figure 3:
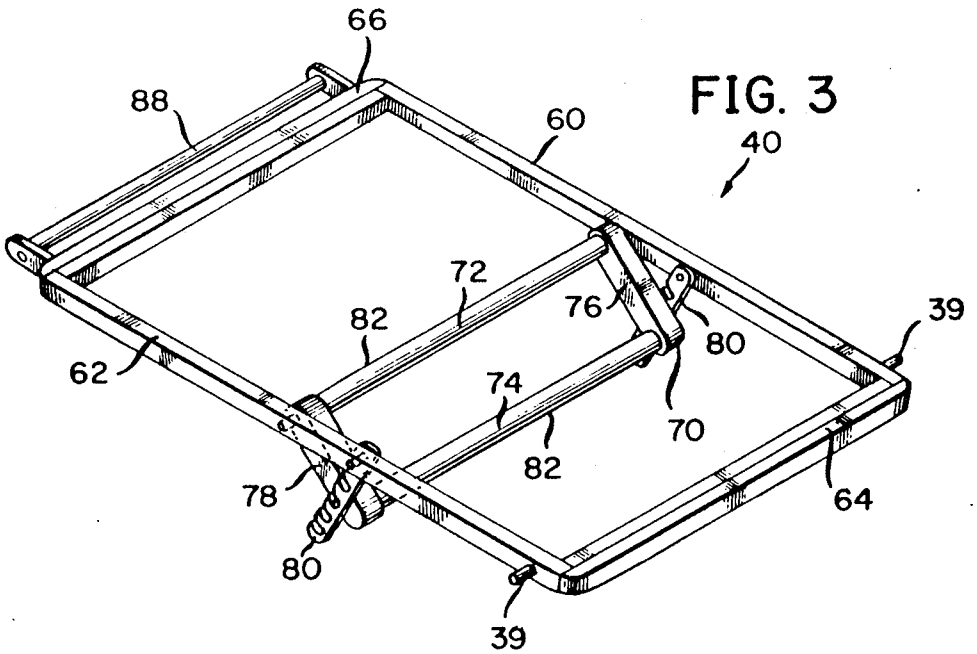
FIG. 3 is a side perspective view of an abdomen support portion of the chair.
Figure 4:
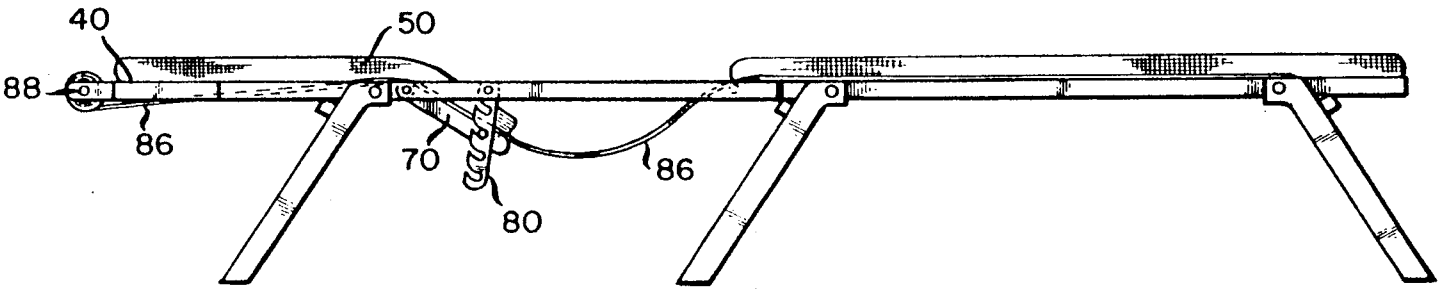
FIG. 4 is a side elevational view of the abdomen support portion of the chair.

FIG. 3 is a perspective cutaway view of third support frame 40. FIG. 4 is a side elevational view of third support frame 40. Referring to FIG. 3, it is shown that third support frame 40 is generally rectangular in configuration having longitudinal side supports 60 and 62 and lateral end supports 64 and 66. Lateral end support 64 is secured to second support frame 22 by means of a dowel or hinge 39 to permit it to be raised from a planer position to an inclined position.

Third support frame 40 will have fixed transverse members 68 for support of cushion 50. Third support frame 40 will also have an adjustable transverse support member 70. Transverse support member 70 is generally rectangular in shape and is positioned between longitudinal support sides 60 and 62 of third support frame 40. A first longitudinal side 72 is rotatably secured to longitudinal side 60 and 62 of third support frame 40. Longitudinal side 72 is secured to longitudinal side 74 by transverse side members 76 and 78. In this configuration, longitudinal member 74 can be rotated downwardly from a planer position with third support frame 40. The amount of downward displacement is adjustable by means of adjustable locking arm 80 which is secured to transverse end member 76 and 78 and longitudinal support member 60 and 62 respectively of third support frame 40 and functions in a manner similar to elevator arms 42.

Longitudinal transverse member 72 and 74 of cross member 70 contain a longitudinal slit 82 therethrough for receipt of support cloth or fabric 86 as described hereafter.

Referring to FIG. 4, third support frame 40 has secured to its transverse end 30, a rotatable dowel or drum 88 upon which a roll of fabric or cloth 86 is rotatably secured. Fabric or cloth 86 can be dispensed from drum 88 and passes under fixed transverse support arm 68 of third support frame 40 and through transverse support arm 70 by means of slits 82 and is then permanently secured to lateral end 64 of third support frame 40. Support cloth or fabric 86 is utilized to support the abdomen of a pregnant woman as more fully described hereafter. Dowel or drum 88 is rotatable in order to allow the desired amount of fabric 86 to be unrolled in order to support the abdomen. Once the desired amount of fabric had been unrolled, dowel or drum 88 is locked to prevent rotation and the unrolling of additional fabric. The locking of dowel or drum 88 is accomplished by anyone of a number of means well known in the art.

When transverse support frame 70 is in a planer position with third support frame 40, support fabric or cloth 86 can be rolled taut on rotatable drum or dowel 88 and cushions 50, 52 and 54 can be positioned such that the chair can be used in either a supine, prone or semi-upright position. If a pregnant woman desired to recline in the prone position, cushion 52 would be removed and cushion 50 would be positioned as shown in FIG. 4. Support cloth or fabric 86 would be unrolled from dowel or drum 88 to provide the desired degree of slack between lateral end 64 of third support frame 40 and transverse support member 70.

As the term of pregnancy increased, the woman may wish to adjust transverse support frame 70 downwardly for comfort. This would help in accommodating the abdomen as well as the chest area. The width of support fabric 86 would be substantially equivalent to the width of third support frame 40. In the desired embodiment, support cloth 86 would pass through the slits in transverse support member 70 but it will be recognized that support fabric 86 could pass over transverse support member 70 and still accommodate the same purpose and function as disclosed herein.

Figure 5:
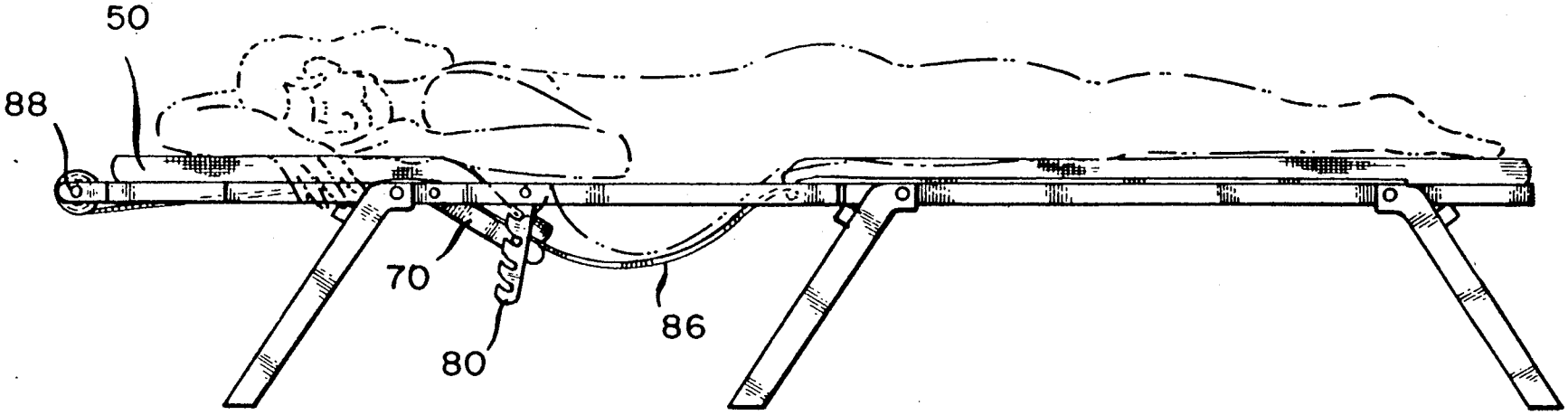
FIG. 5 is a side elevational view of the chair illustrating its use by a pregnant woman.

FIG. 5 illustrates the use of chair 10 by a pregnant woman utilizing the chair in the prone position. Cushion 52 has been removed and the abdomen of the woman is supported by fabric 86. In the configuration shown, the expansion area for accommodating the pregnant woman's abdomen and stomach is located above the pivotal section of chair 10 to provide for maximum comfort. In the embodiment as shown, the user has a chair which is collapsible and easily transportable and which can be used in the normal fashion, yet is easily adaptable for use by a pregnant woman in order to permit her to recline in a prone position outdoors or at the beach or to utilize the chair as a cot or bed at home for reclining in a prone position. Further, when used by the pregnant woman reclining in a prone position, the chair provides continuous body support to the lower torso, upper torso and abdomen.

While the present invention has been described in connection with the exemplary embodiment thereof, it will be understood that many modifications will be apparent to those or ordinary skill in the art and that this application is intended to cover any adaptations or variations thereof. Therefore, it is manifestly intended that this invention be only limited by the claims and the equivalents thereof.

I claim:

1. A chair assembly adaptable for comfortably supporting the abdomen of a pregnant woman in a prone position comprising:

a first support frame having a first end and a second end, a second support frame having a first end and a second end, said first support frame and said second support frame pivotly secured to each other at said first ends, said first support frame and second support frame having support legs connected thereto;

a third support frame having a first end and a second end, said first end pivotly secured to a said second support frame proximate to said first end of said second support frame and coincidental therewith, said third support frame pivotable from a substantially planer horizontal position coincidental with said second support frame and said first support frame to a securable, angled position with said first support frame and said second support frame;

an adjustable chest support frame pivotally transversely secured to said third support frame, said chest support frame pivotally securable from a horizontal position with said third support frame to a lower position;

an adjustable abdomen support means longitudinally positioned between said first end and said second end of said third support frame;

a body support means comprising a plurality of cushions removable securable to said first support frame and said third support frame, said body support means discontinuously adjustable to provide accommodation and support for the abdomen and chest of said pregnant woman in a prone position by said chest support frame and said abdomen support means.

2. A chair assembly in accordance with claim 1 wherein said adjustable abdomen support means comprises a cloth material adjustable from a taut position between said first end and said second end of said third support frame to a suspended position between said first end and said second end of said third support frame.

3. A chair assembly in accordance with claim 2 wherein said adjustable abdomen support means is adjustable between said taut position and said suspended position by means of a roller having said abdomen support means secured thereabout, said roller for dispensing said abdomen support means and said roller lockably engageable to secure said abdomen support means.

4. A chair assembly in accordance with claim 1 wherein said adjustable chest support frame cooperates with adjustable abdomen support means to position said adjustable abdomen support means in a suspended position between said adjustable chest support frame and said first end of said third support frame.

5. A chair assembly in accordance with claim 1 wherein said first support frame, said second support frame and said third support frame are hingeably rotatable with respect to each for the folding and transportation of said chair assembly.

* * * * *